US010133236B2

(12) United States Patent
Omichi et al.

(10) Patent No.: US 10,133,236 B2
(45) Date of Patent: Nov. 20, 2018

(54) IMAGE FORMATION APPARATUS HAVING FILTER MEMBER

(71) Applicants: KONICA MINOLTA, INC., Chiyoda-ku, Tokyo (JP); KONICA MINOLTA TECHNOLOGY DEVELOPMENT (WUXI) CO., LTD., Wuxi, Jiangsu (CN)

(72) Inventors: Yoshiki Omichi, Toyokawa (JP); Hai Jin Zhang, Jiangsu (CN); Min wen Zhang, Jiangsu (CN)

(73) Assignees: KONICA MINOLTA, INC., Chiyoda-Ku, Tokyo (JP); KONICA MINOLTA TECHNOLOGY DEVELOPMENT (WUXI) CO., LTD., Wuxi, Jiangsu (CN)

( * ) Notice: Subject to any disclaimer, the term of this patent is extended or adjusted under 35 U.S.C. 154(b) by 0 days.

(21) Appl. No.: 15/267,308

(22) Filed: Sep. 16, 2016

(65) Prior Publication Data

US 2017/0082973 A1 Mar. 23, 2017

(30) Foreign Application Priority Data

Sep. 18, 2015 (CN) ..... 2015 1 0599856

(51) Int. Cl.
*G03G 21/20* (2006.01)
*G03G 15/00* (2006.01)

(52) U.S. Cl.
CPC ..... *G03G 21/206* (2013.01); *G03G 15/6552* (2013.01); *G03G 2215/00421* (2013.01)

(58) Field of Classification Search
CPC ..... G03G 15/6552; G03G 21/206; G03G 2215/00421
USPC ..... 399/93
See application file for complete search history.

(56) References Cited

U.S. PATENT DOCUMENTS

| | | | | |
|---|---|---|---|---|
| 8,218,157 | B2 * | 7/2012 | Saito | H04N 1/00 347/101 |
| 2007/0121142 | A1 * | 5/2007 | Kasai | G03G 21/206 358/1.12 |
| 2016/0023491 | A1 * | 1/2016 | Vellutato, Jr. | B41J 29/377 312/50 |

FOREIGN PATENT DOCUMENTS

| | | | | |
|---|---|---|---|---|
| JP | H01-155059 | U | | 10/1989 |
| JP | H04-322720 | A | | 12/1992 |
| JP | H05-076726 | A | | 3/1993 |
| JP | 10143031 | A | * | 5/1998 |
| JP | 2007322809 | A | * | 12/2007 |
| JP | 2012068489 | A | * | 4/2012 |
| JP | 2013092561 | A | * | 5/2013 |

(Continued)

OTHER PUBLICATIONS

Notice of Grounds of Rejection dated Dec. 19, 2017 issued by the Japanese Patent Office in corresponding Japanese Patent Application No. 2016-171930 and English translation (7 pages).

(Continued)

*Primary Examiner* — Robert Beatty
(74) *Attorney, Agent, or Firm* — Buchanan Ingersoll & Rooney PC

(57) ABSTRACT

The present image formation apparatus includes a sheet output tray and an apparatus body underlying the sheet output tray, a duct being formed inside the apparatus body, a filter member being attached inside the duct, the filter member having a portion exposed outside the apparatus body, the filter member's exposed portion also serving as a portion of the sheet output tray.

19 Claims, 5 Drawing Sheets

(56) References Cited

FOREIGN PATENT DOCUMENTS

| | | | | |
|---|---|---|---|---|
| JP | 2013195898 | A | * | 9/2013 |
| JP | 2014-071293 | A | | 4/2014 |
| JP | 2014071293 | A | * | 4/2014 |

OTHER PUBLICATIONS

Office Action (Notice of Grounds of Rejection) dated Apr. 17, 2018, by the Japanese Patent Office in corresponding Japanese Patent Application No. 2016-171930, and an English Translation of the Office Action. (8 pages).

* cited by examiner

IMAGE FORMATION APPARATUS HAVING FILTER MEMBER

This application is based on Chinese Patent Application No. 201510599856.X filed with the Chinese Patent Office on Sep. 18, 2015, the entire content of which is hereby incorporated by reference.

BACKGROUND OF THE INVENTION

Field of the Invention

The present invention relates to an image formation apparatus, and particularly to an image formation apparatus allowing a filter to be removed at a sheet output tray.

Description of the Related Art

General image formation apparatuses are provided with a duct therein, a fan and a filter are attached to the duct, and the fan sucks air and the filter removes ozone and provides deodorization.

In order to ensure a filtration effect, it is necessary to replace the filter with another periodically. Conventionally, to help filter replacement, normally, the filter is disposed at an exhaust port which exhausts air to outside the apparatus. However, there is a long distance between the exhaust port and the image formation unit, and accordingly, pressure loss is caused resulting in an impaired filtration effect.

In order to increase removal efficiency, it is preferable to dispose the filter and the fan at a location near the image formation unit to reduce the duct's distance to thus suppress pressure loss. For example the filter may be attached to the image formation unit and thus allowed to be replaced together with the image formation unit integrally. However, the image formation unit is replaced by a serviceman and cannot be replaced by the user per se. In addition, the replacement of the filter is done together with the replacement of the image formation unit integrally, and as the replacement of the image formation unit is thus costly, the filter is normally replaced in accordance with the image formation unit's replacement period and thus cannot be replaced depending on its state of use.

Alternatively, the filter may be disposed individually at a location close to the image formation unit. In that case, the filter is disposed inside the apparatus, and can be replaced by the user per se, however, there are disposed a large number of parts involved in image formation, and replacing the filter is still a cumbersome operation for the user.

If the method described in Japanese Laid-Open Patent Publication No. 2014-71293 is used, the replacement operation requires removing a cover of the main body of the apparatus, which is inefficient in operability, and furthermore, it is impossible to replace the filter while an image is formed

SUMMARY OF THE INVENTION

The present invention has been made in view of the above actual circumstances, and an object of the present invention is to provide an image formation apparatus allowing a user per se to easily replace a filter member without removing the cover.

To achieve at least one of the abovementioned object, according to an aspect, an image formation apparatus reflecting one aspect of the present invention comprises a sheet output tray, and an apparatus body underlying the sheet output tray, the image formation apparatus having a duct inside the apparatus body, a filter member being provided inside the duct, the filter member having a portion exposed outside the apparatus body, the filter member's exposed portion also serving as a portion of the sheet output tray.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An image formation apparatus in an embodiment based on the present invention will be described hereinafter with reference to the drawings. Note that in the embodiments described hereafter, when numbers, amounts and the like are referred to, the present invention is not necessarily limited in scope thereto unless otherwise indicated. Identical and corresponding components are identically denoted and may not be described repeatedly. Furthermore, the drawings do not follow the actual dimensional ratio, and to help understanding the structure, there is a portion shown with a modified ratio to clarify the structure.

Hereinafter, with reference to the figures, an image formation apparatus according to an embodiment will be described in detail.

First Embodiment

Figure 1:
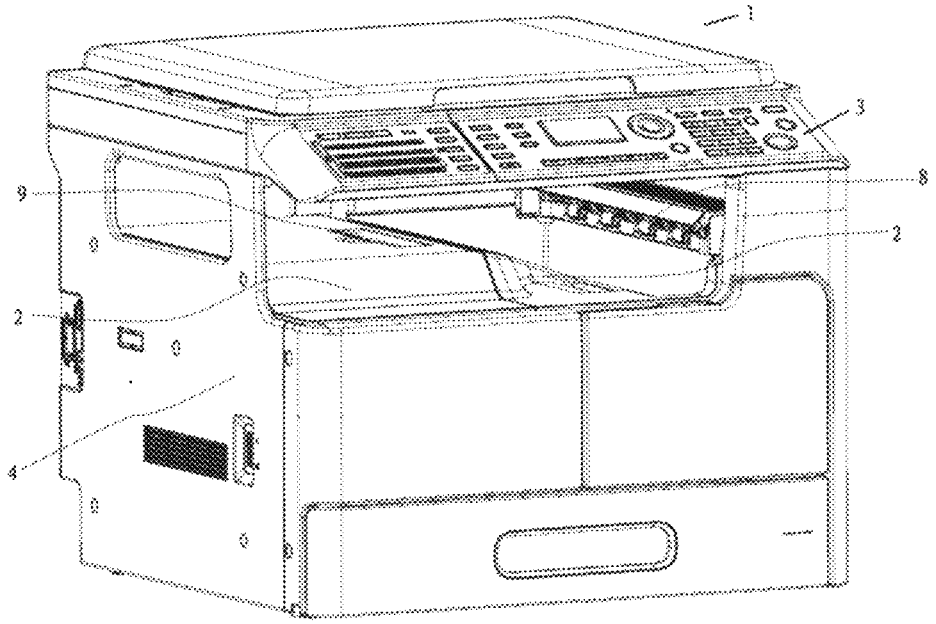
FIG. 1 is a perspective view of an image formation apparatus according to a first embodiment.
Figure 2:
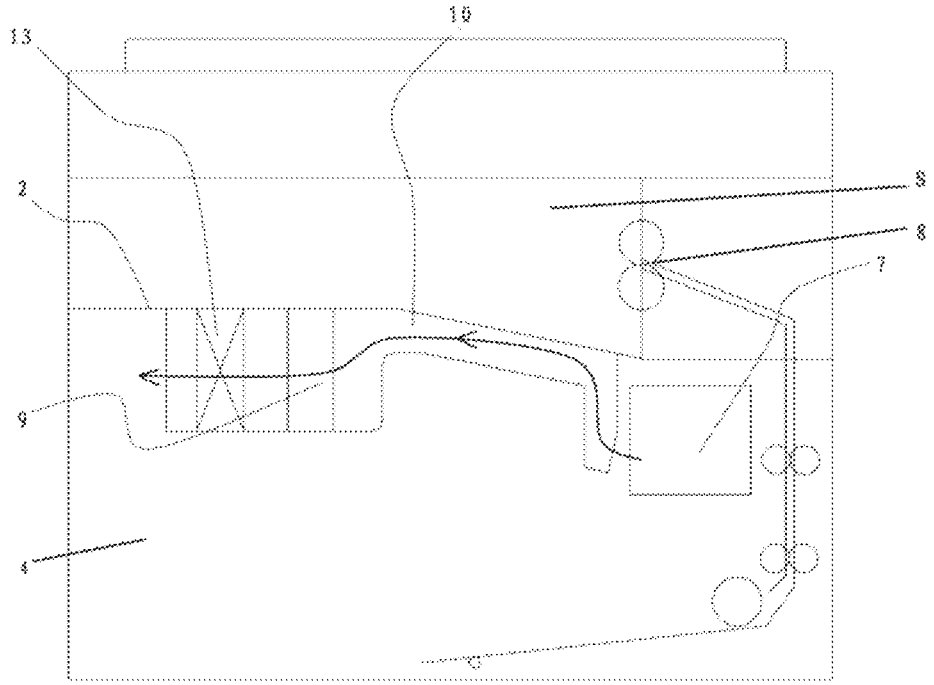
FIG. 2 is a cross section of the image formation apparatus shown in FIG. 1.

FIG. 1 is a perspective view of an image formation apparatus 1 according to a first embodiment. FIG. 2 is a cross section of image formation apparatus 1 shown in FIG. 1. This image formation apparatus 1 (hereafter also simply referred to as an "apparatus") includes a sheet output tray 2, a reading unit 3 overlying sheet output tray 2, and an apparatus body 4 underlying sheet output tray 2.

Reading unit 3 and apparatus body 4 are the same as those of a conventional image formation apparatus. Sheet output tray 2 underlies reading unit 3, and on a left side of sheet output tray 2, there is a sheet discharging port 8. A sheet is discharged from sheet discharging port 8 and left on a surface of sheet output tray 2. Image formation apparatus 1 has a space S between sheet output tray 2 and reading unit 3. A filter member is suitable for being attached to the image formation apparatus having space S. However, the filter member is not limited as such, and it is also applicable to a model which has reading unit 3 provided on the side of the body, i.e., does not have reading unit 3 overlying sheet output tray 2, a printer which does not have reading unit 3, and the like.

Apparatus body 4 is under sheet output tray 2 and is provided therein with a power supply (not shown), a sheet cassette (not shown), an image unit (IU) 7, a duct 10 and the like. Duct 10 is mainly provided for generating an air stream in the image formation apparatus. Duct 10 is generally a hollowed pipeline, and has opposite ends opened, with one opening close to image unit 7, and the opening in communication with the atmosphere.

Duct 10 passes air, which for example contains ozone, which is discharged together with the air to the atmosphere. In order to reduce them effectively, normally, duct 10 of image formation apparatus 1 is provided with a filter member for filtration. Filter member 9 is provided in duct 10 such that, as shown in FIG. 1 and FIG. 2, filter member 9 has an upper end exposed outside apparatus body 4.

Figure 3:
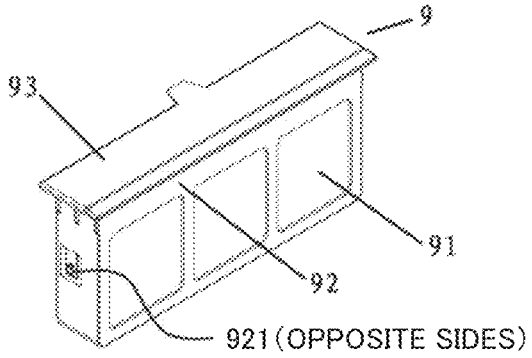
FIG. 3 is a perspective view of a filter member according to the first embodiment.

As shown in FIG. 3, filter member 9 is substantially a rectangular parallelepiped, and has a filter 91 and a housing 92 made of resin which surrounds filter 91. For example if filter 91 is an ozone filter, it can be formed of a material identical to an ozone filter of a conventional image formation apparatus to filtrate ozone. By inserting filter member 9 into apparatus body 4 at a prescribed position, filter member 9 can be combined with duct 10 to filtrate ozone passing through duct 10. Furthermore, when filter member 9 is inserted in apparatus body 4, filter member 9 has an upper end portion 93 (an upper surface of housing 92) exposed outside apparatus body 4 and matched to a surface of sheet output tray 2, and thus also serving as a portion of sheet output tray 2.

Figure 4A:
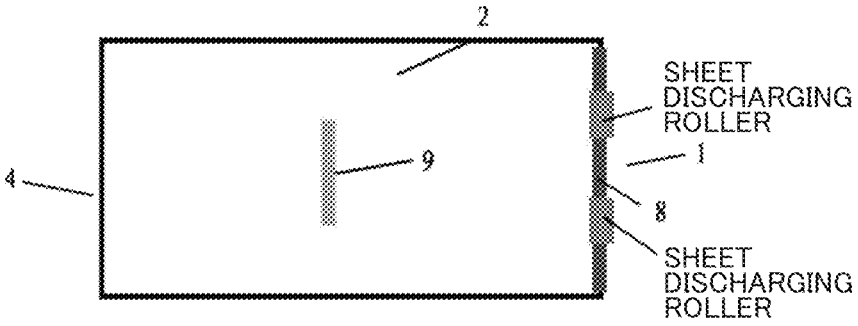
FIG. 4A is a schematic top view of the image formation apparatus shown in FIG. 1.
Figure 4B:
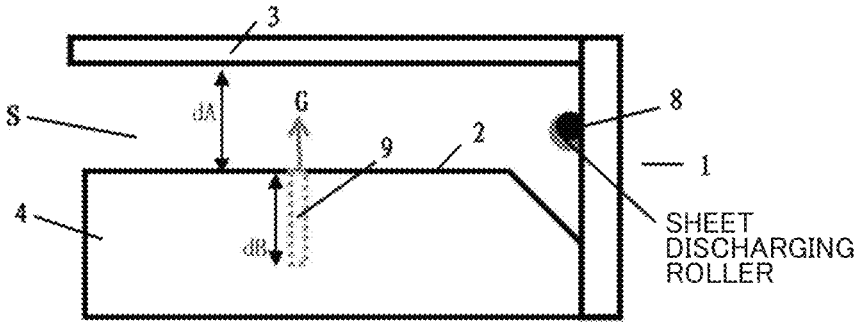
FIG. 4B is a schematic front view of the image formation apparatus shown in FIG. 1.

FIGS. 4A and 4B schematically show image formation apparatus 1 shown in FIG. 1, and FIG. 4A is a top view thereof and FIG. 4B is a front view thereof. As shown in FIG. 4B, a dotted line shows filter member 9 of the present embodiment. By being attached to duct 10 inside apparatus body 4, filter member 9 can provide effective filtration. As shown in FIG. 2 and FIG. 4B, filter member 9 has an upper end exposed outside apparatus body 4. The portion of filter member 9 exposed outside apparatus body 4 allows filter member 9 to be extracted outside apparatus body 4 and thus removed. Thus, filter member 9 can be directly taken and replaced without removing a cover which covers the apparatus. This can simplify an operation of replacing the filter member, makes the user's or maintainer's apparatus maintenance convenient, and is advantageous in extending the apparatus's lifetime for use.

Furthermore, as shown in FIGS. 1-4B, image formation apparatus 1 has sheet discharging port 8, and a sheet is passed through sheet discharging port 8 and thus discharged onto a surface of sheet output tray 2. The exposed portion (or upper end) of filter member 9 also serves as a portion of sheet output tray 2, and accordingly the apparatus's design is ensured and the sheet output operation is not prevented, either, and can thus be performed smoothly.

As shown in FIGS. 1 and 2 and FIG. 4B, reading unit 3 overlies sheet output tray 2, and between reading unit 3 and sheet output tray 2 there is a space S, which ensures a space for an operation for replacing filter member 9. As shown in FIG. 4B, when a minimum distance between a lower surface of reading unit 3 and an upper surface of sheet output tray 2 in a vertical direction is represented as dA and a height of filter member 9 in the vertical direction is represented as dB, then, in order to remove filter member 9 from apparatus body 4 smoothly, height dB of filter member 9 is set to satisfy a relationship of dA>dB.

According to the configuration of the first embodiment above, when the user or the maintainer replaces filter member 9, he/she inserts his/her hand into space S between reading unit 3 and sheet output tray 2 and extracts filter member 9 upwards by the portion of filter member 9 exposed outside apparatus body 4 (note that an arrow G indicates a direction in which filter member 9 is extracted). As height dB of filter member 9 is smaller than minimum distance dA between the lower surface of reading unit 3 and the upper surface of sheet output tray 2, filter member 9 can be extracted from apparatus 4 smoothly and thus replaced, and it is not necessary to first remove a cover of the apparatus body and then extract filter member 9, as conventional. The present embodiment can thus simplify the operation of replacing filter member 9.

Second Embodiment

Figure 5:
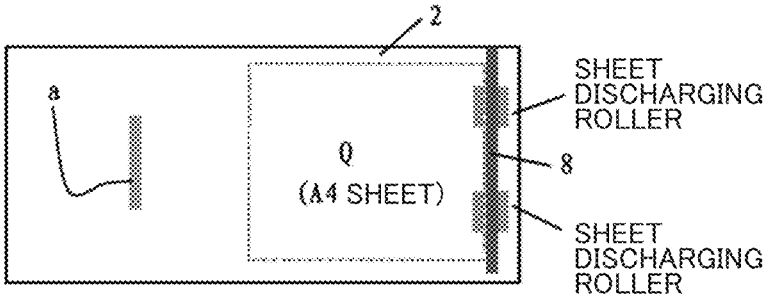
FIG. 5 is a schematic top view of an image formation apparatus according to a second embodiment.

FIG. 5 is a schematic top view of image formation apparatus 1 according to a second embodiment. As shown in FIG. 5, sheet output tray 2 has a region surrounded by a dotted line, which indicates a sheet output region Q. A sheet is discharged from sheet discharging port 8 and disposed on a surface of sheet output tray 2 within a range of sheet output region Q. Sheet output region Q may be set to be a maximum size of a printing sheet or a frequently used size, as required by the user. For example, in the present embodiment, sheet output region Q is set to have the size of a printing sheet of A4, and when the A4 printing sheet is printed and discharged from sheet discharging port 8, it is output within sheet output region Q.

In the present embodiment, as shown in FIG. 5, when an A4 sheet is discharged from sheet discharging port 8 and discharged along a surface of sheet output tray 2 into A4 sheet output region Q, with filter member 9 in a region other than A4 sheet output region Q, the discharged A4 sheet does not impinge on the exposed portion of filter member 9 and thus does not affect sheet output performance.

Third Embodiment

Figure 6A:
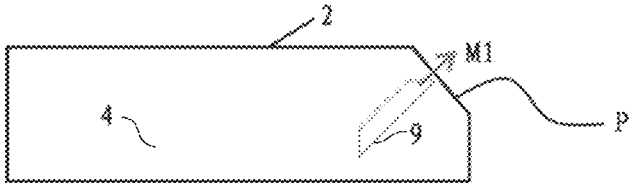
FIG. 6A is a schematic front view of an image formation apparatus according to a third embodiment, showing the filter member ejected in a direction perpendicular to an inclined surface.
Figure 6B:
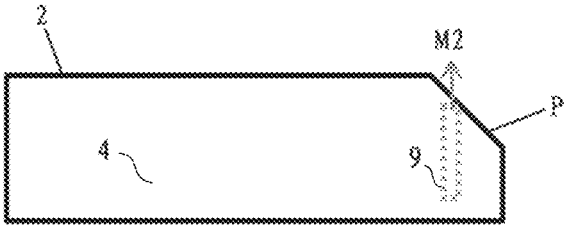
FIG. 6B is a schematic front view of the image formation apparatus according to the third embodiment, showing the filter member ejected in an exactly upward direction.

FIGS. 6A and 6B are schematic front views of image formation apparatus 1 according to a third embodiment, and FIG. 6A shows filter member 9 ejected in a direction M1 perpendicular to an inclined surface P and FIG. 6B shows filter member 9 ejected in an exactly upward direction M2. As shown in FIG. 2 and FIG. 4A, sheet output tray 2 has a portion (inclined surface) P which inclines relative to a sheet discharging direction (a direction from the right side to the left side in the figure). Filter member 9 is disposed at a portion of apparatus body 4 corresponding to inclined surface P, and a direction in which filter member 9 is ejected (or extracted from apparatus body 4) is set in a direction perpendicular to inclined surface P (Note that an arrow M1 indicates a direction in which filter member 9 is extracted). Thus, when filter member 9 is replaced, it will be extracted and replaced in the direction perpendicular to inclined surface P and a direction opposite to apparatus body 4. After the replacement is completed, filter member 9 is inserted into and thus attached to apparatus 3. Note that filter member 9 is inserted in a direction opposite to that in which filter member 9 is extracted.

Thus a space between inclined surface P of sheet output tray 2 and reading unit 3 is larger, and a space for replacing filter member 9 is also increased and thus helps operation.

Similarly, in the present embodiment, as shown in FIG. 6B, when filter member 9 is disposed at the portion of inclined surface P of sheet output tray 2, it may be provided such that its extraction or insertion direction is not only perpendicular to inclined surface P, but, for example, its extraction direction is an exactly upward direction (a direction indicated by an arrow M2), that is, the filter member's heightwise direction is inclined toward a downstream side in the sheet discharging direction. This configuration can similarly increase a space for replacing filter member 9 and thus allows a convenient operation.

Fourth Embodiment

Figure 7A:
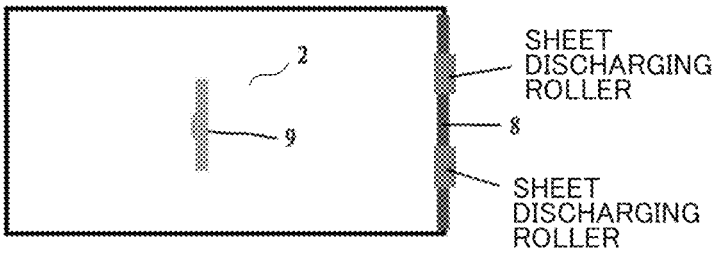
FIG. 7A is a schematic top view of an image formation apparatus according to a fourth embodiment.
Figure 7B:
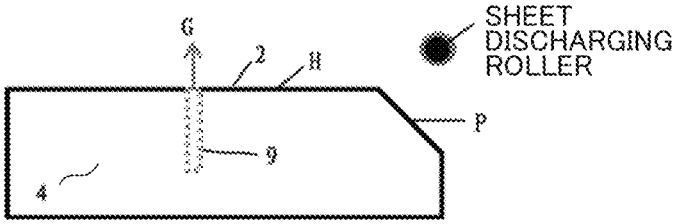
FIG. 7B is a schematic front view of the image formation apparatus according to the fourth embodiment.

FIGS. 7A and 7B schematically show image formation apparatus 1 according to a fourth embodiment, and FIG. 7A is a top view thereof and FIG. 7B is a front view thereof.

As shown in FIG. 7B, sheet output tray 2 has a portion (inclined surface) P which inclines relative to the sheet discharging direction, and a horizontal portion (a horizontal surface) H extending in a rightward and leftward direction. The present embodiment differs from the third embodiment in that filter member 9 is disposed at a portion of apparatus body 4 corresponding to horizontal surface H. Note that although filter member 9 is disposed at the portion of apparatus body 4 corresponding to horizontal surface H, filter member 9 may be disposed in a region other than sheet output region Q.

Filter member 9 attached to and thus disposed at the portion of apparatus body 4 corresponding to horizontal surface H is extracted from sheet output tray 2 at a region of horizontal surface H (For example, arrow G indicates a direction in which filter member 9 is extracted). The region of horizontal surface H is larger than inclined surface P, and accordingly, space S corresponding thereto is also large. This allows filter member 9 to be disposed conveniently and also allows the user or the maintainer to replace filter member 9 through a convenient operation.

Fifth Embodiment

Figure 8:
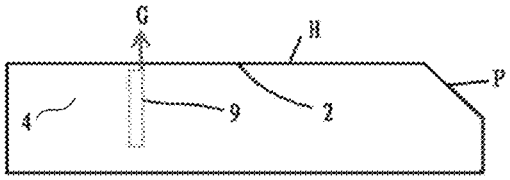
FIG. 8 is a schematic front view of an image formation apparatus according to a fifth embodiment.

FIG. 8 is a schematic front view of image formation apparatus 1 according to a fifth embodiment. As shown in FIG. 8, sheet output tray 2 has a portion (inclined surface) P which inclines relative to the sheet discharging direction, and a horizontal portion (a horizontal surface) H extending in a rightward and leftward direction. In the present embodiment, filter member 9 is attached to and thus disposed at a portion of apparatus body 4 corresponding to horizontal surface H excluding sheet output region Q, and filter member 9 is disposed such that its heightwise direction is perpendicular to horizontal surface H of sheet output tray 2. Thus, when filter member 9 is extracted in its heightwise direction (the direction indicated by arrow G), it can be extracted from apparatus body 4 perpendicularly to horizontal surface H of sheet output tray 2.

Thus, when filter member 9 is replaced, it can be extracted in the direction perpendicular to horizontal surface H of sheet output tray 2, that is, it can be extracted exactly upward, so that the user or the maintainer can easily bias force to filter member 9 to extract it from apparatus 4 and thus also replace it by a convenient operation, and furthermore, if a contaminant adheres to filter member 9, filter member 9 is vertically extracted and the contaminant does not easily fall from filter member 9.

Sixth Embodiment

Figure 9:
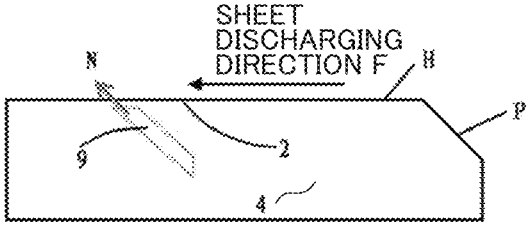
FIG. 9 is a schematic front view of an image formation apparatus according to a sixth embodiment.

FIG. 9 is a schematic front view of image formation apparatus 1 according to a sixth embodiment. As shown in FIG. 9, sheet output tray 2 has a portion (inclined surface) P which inclines relative to the sheet discharging direction, and a horizontal portion (a horizontal surface) H extending in a rightward and leftward direction. Filter member 9 is attached to and thus disposed at a portion of apparatus body 4 corresponding to horizontal surface H excluding sheet output region Q, and it is located at a position on a side downstream of sheet output region Q in the sheet discharging direction. The present embodiment differs from the fifth embodiment in that filter member 9 is disposed to have its heightwise direction inclined toward the downstream side in the sheet discharging direction.

As indicated in FIG. 9, in the figure, an arrow F directed from a right side to a left side indicates the sheet discharging direction, and the right side is an upstream side in the sheet discharging direction and the left side is a downstream side in the sheet discharging direction. A sheet is discharged in the direction of arrow F. Furthermore, an arrow N indicates a direction in which filter member 9 is extracted. Thus, filter member 9 is extracted in a direction inclined relative to the sheet discharging direction along the downstream side in the sheet discharging direction.

Filter member 9 disposed to have its heightwise direction inclined toward the downstream side in the sheet discharging direction, can be extracted such that it is inclined toward the downstream side in the sheet discharging direction. A space on the downstream side in the sheet discharging direction is large, so that even when a distance between the upper surface of sheet output tray 2 and the lower surface of reading unit 3 is small, extracting and replacing filter member 9 can also be done conveniently and smoothly. Furthermore, as filter member 9 is extracted such that it is inclined toward the downstream side in the sheet discharging direction, and filter member 9 is also located at a position on a side downstream of sheet output region Q in the sheet discharging direction, dirt filtrated is less likely to fall on sheet output region Q, and a sheet is thus prevented from contamination.

Seventh Embodiment

Figure 10:
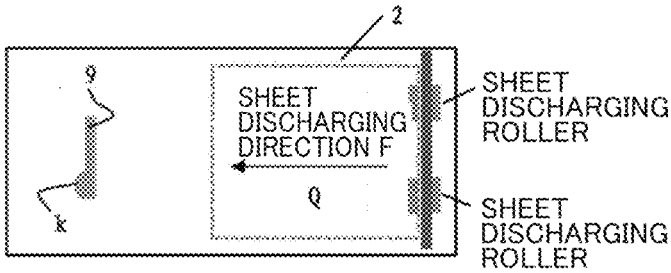
FIG. 10 is a schematic top view of an image formation apparatus according to a seventh embodiment.

FIG. 10 is a schematic top view of image formation apparatus 1 according to a seventh embodiment. As shown in FIG. 10, arrow F indicates a sheet discharging direction. Filter member 9 is attached to and thus provided at a portion of apparatus body 4 excluding sheet output region Q, and it is located at a position on a side downstream of sheet output region Q in the sheet discharging direction. An upper end of filter member 9. i.e., an exposed portion of the housing of filter member 9 is flush with and parallel to a surface of sheet output tray 2. And a handle K is provided to this upper end. Handle K is formed to be integrated with the upper end of filter member 9, and handle K may project from the upper end to a periphery of housing 92, be recessed inward, or furthermore, be a hole allowing a finger to be inserted therein. When replacing filter member 9, the user can hang handle K by hand. Furthermore, handle K is provided at the upper end of filter member 9 at a location closer to the user as seen in a frontward and backward direction (a front view direction) of image formation apparatus 1.

Thus, handle K is provided at the upper end of filter member 9, and when replacing filter member 9, the user hangs handle K by hand to hold the upper end (or exposed portion) of filter member 9, and lifts filter member 9 at the upper end upward in the extraction direction to extract filter member 9 from apparatus 4 and thus replace it. As handle K is provided, filter member 9 can be easily lifted upward and thus extracted, and thus replaced by a convenient operation. Furthermore, handle K provided at a location close to the user is also conveniently held by the user.

Eighth Embodiment

Figure 11:
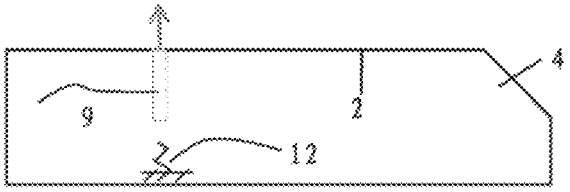
FIG. 11 is a schematic front view of an image formation apparatus according to an eighth embodiment.

FIG. 11 is a schematic front view of an image formation apparatus according to an eighth embodiment. As shown in FIG. 11, image formation apparatus 1 further includes a push open member 12, and push open member 12 is composed for example of a spring member, and attached to an interior of apparatus body 4 and located at a position corresponding to an end of filter member 9 that is inside apparatus body 4 (e.g., downwardly of filter member 9). As a matter of course, it is also possible to dispose push open member 12 on a lower surface of housing 92 of filter member 9. When provided inside apparatus body 4, push open member 12 may have one end (for example a lower end) fixed to apparatus body 4 by a holder etc., and the other end (for example an upper end) out of contact with filter member 9 in a normal state or in contact with a lower surface of housing 92 of filter member 9 with an original length (without the spring resiliently deformed) maintained. Thus, in the normal state, push open member 12 is not resiliently deformed. When filter member 9 is pushed, the lower surface of housing 92 of filter member 9 contacts the other end of push open member 12 and thus biases push open member 12. Thus, push open member 12 is resiliently deformed and a resilient force is thus caused and biases filter member 9. When pressing filter member 9 is stopped and filter member 9 is released, filter member 9 is sprung by the resilient force upward out of apparatus body 4 (in a direction indicated in FIG. 11 by an arrow), and the end (e.g., the upper end) of filter member 9 exposed outside apparatus 4 projects outward from a surface of sheet output tray 2.

Thus, by pressing filter member 9, filter member 9 is caused to automatically spring upward out of the apparatus body to also allow the user to extract and replace filter member 9 conveniently.

Furthermore, as shown in FIG. 3, housing 92 as seen in its longitudinal direction has opposite sides each provided with a securing member 921 for securing filter member 9 in apparatus body 4 to duct 10.

Securing member 921 is formed to be integrated with housing 92 made of resin of filter member 9. Securing member 921 is cantilevered, and has one end provided with a hook engaged to a wall surface of the duct and the other end serving as a foot connected to and thus formed to be integrated with housing 92. Between the hook and the foot, there is an intermediate portion, which is formed in an elongate piece and connects the hook and the foot. The hook, as seen in a direction in which filter member 9 is inserted, has opposite edges chamfered to guide an operation of inserting or ejecting filter member 9 to facilitate an operation of replacing filter member 9 corresponding thereto.

Furthermore, when filter member 9 has securing member 921, the duct has a recess at a position corresponding to securing member 921 to engage with securing member 921. When inserting filter member 9 into the apparatus, securing member 921 inserts the hook into the corresponding recess via the chamfer located at a front side in the inserting direction, and by the engagement of the hook and the recess on the opposite sides, filter member 9 is secured to the duct. Thus, filter member 9 can be firmly secured to the duct and further effectively filtrate ozone flowing through the duct.

Furthermore, the filter member according to each embodiment can also filtrate paper powder, fine granules, etc., and this is implemented by disposing a filter corresponding thereto. In each embodiment, preferably, ozone is filtrated.

Ozone is generated in the IU unit by a charger. As ozone contaminates environment (an office's indoor environment in particular), and accordingly, before ozone is discharged outside the apparatus, it is necessary to suck the air of the IU unit by the fan and the duct and remove ozone by the filter. Accordingly, preferably, the filter and the fan are provided in a vicinity of the IU unit.

Furthermore, ozone is a gas, and in replacing the filter member when the filter member is extracted from the sheet output tray and thus ejected therefrom, there is no granular impurity left on the filter for example, and the sheet output tray and hence a sheet discharged are not contaminated.

Ninth Embodiment

Figure 12:
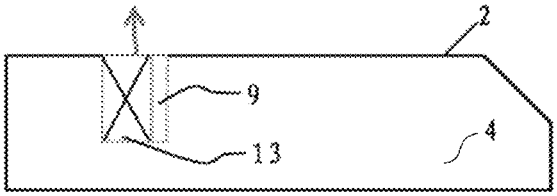
FIG. 12 is a schematic front view of an image formation apparatus according to a ninth embodiment.

FIG. 12 is a schematic front view of an image formation apparatus according to a ninth embodiment excluding a reading unit. As shown in FIG. 12, inside apparatus body 4 of image formation apparatus 1, a fan 13 is provided to form a stream of air in the duct and guide the air stream to cause the air to flow smoothly. In the present embodiment, fan 13 and filter member 9 are disposed as a single assembly member, and the remainder in structure is identical to the first embodiment. Thus, when filter member 9 is replaced, filter member 9 can be extracted together with fan 13, and fan 13 can be replaced simultaneously. By this structure, the fan can be conveniently replaced.

Figure 13:
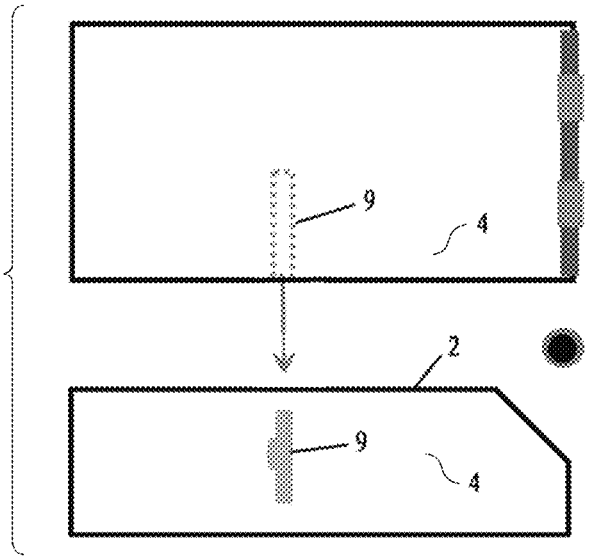
FIG. 13 schematically shows a filter member ejected from a front side of the apparatus body of the image formation apparatus.

Furthermore, while in the above embodiment an example has been described in which an exposed portion of filter member 9 is located at sheet output tray 2, in addition thereto, as shown in FIG. 13, the exposed portion of filter member 9 can also be located at a side surface of apparatus body 4 of image formation apparatus 1 which is closer to the user as seen in the front view direction. Thus, filter member 9 can be extracted on the user's side, a space for operation is further sufficient, the user or the maintainer can replace filter member 9 through a convenient operation, and furthermore, the filter can be replaced even during a job.

The above embodiments are not exclusive, and the present invention can be implemented by a variety of types of structures within a range which does not depart from its gist. For example, a technological feature of each embodiment described in the disclosure of the invention is exchangeable or combinable as appropriate. Furthermore, any portion that is not described as a required technological feature in the present specification may be deleted as appropriate.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

The image formation apparatus includes a sheet output tray, and an apparatus body underlying the sheet output tray, the image formation apparatus having a duct inside the apparatus body, a filter member being provided inside the duct, the filter member having a portion exposed outside the apparatus body, the filter member's exposed portion also serving as a portion of the sheet output tray.

In the image formation apparatus, the filter member has a portion exposed outside the apparatus body under the sheet output tray. The portion of the filter member exposed outside the apparatus body allows the filter member to be extracted from the apparatus body. Thus the filter member can be extracted from the apparatus without opening a cover covering the apparatus, and the filter member can thus be replaced by a simple operation. The filter member's exposed portion serving as a portion of the sheet output tray ensures the apparatus's design, and also allows a sheet to be discharged smoothly, and furthermore, even while an image is being formed, the filter member can be extracted and thus replaced without interrupting a job.

Furthermore, as the reading unit overlies the sheet output tray, a space is formed between the sheet output tray and the reading unit, so that when replacing the filter member, a space for operation is ensured and the filter member can be extracted smoothly.

In the image formation apparatus, preferably, the filter member's exposed portion is located in a region of the sheet output tray excluding a prescribed sheet output region. Thus, sheet output performance is not affected and an operation to replace the filter member is not prevented, either.

In the image formation apparatus, preferably, the filter member is disposed in a region of the sheet output tray forming an inclined surface. This allows the filter member to be replaced in an increased space and hence in a convenient operation.

In the image formation apparatus, preferably, the filter member is disposed in a region of the sheet output tray forming a horizontal surface. The region of the sheet output tray forming a horizontal surface is a large region, and accordingly, the filter member is disposed conveniently and also replaced by a convenient operation.

In the image formation apparatus, preferably, the filter member is disposed to have its heightwise direction perpendicular to a surface of the sheet output tray. Thus, when the filter member is assembled/extracted in its heightwise direction, the filter member may be inserted or ejected perpendicularly relative to the surface of the sheet output tray, and the filter member is thus replaced in a simple and hence convenient operation.

In the image formation apparatus, preferably, the filter member is disposed to have its heightwise direction inclined toward a downstream side in a sheet discharging direction. A space on the downstream side in the sheet discharging direction is large, and if a space between the sheet output tray and the reading unit has a low height, the filter member can be assembled/ejected in its heightwise direction such that it can be inserted/ejected smoothly. Not only is the replacement operation unaffected, but dirt filtrated is also less likely to fall on the sheet output region.

In the image formation apparatus, preferably, the filter member has a height smaller than a minimum distance from the sheet output tray to the reading unit. This ensures a space for replacing the filter member and also makes the replacement operation convenient.

In the image formation apparatus, preferably, the filter member's exposed portion is flush with the sheet output tray, and the filter member further has a handle, and the handle is provided at the exposed portion on a downstream side in the sheet discharging direction. The handle and the filter member's exposed portion flush with the sheet output tray allow the user or the maintainer to replace the filter member in a convenient operation. As the handle is provided downstream in the sheet discharging direction, it does not affect discharging a sheet.

Furthermore, as the handle is disposed on a side closer to the user, the user or the maintainer can hold the handle and thus extract the filter member without inserting his/her hand to reach the back side, which makes the replacement operation convenient.

The image formation apparatus preferably further has a push open member allowing the filter member to spring upward out of the body when the filter member is pushed This allows the user or the maintainer to eject the filter member conveniently.

In the image formation apparatus, preferably, the filter member is an ozone filter. Although this filter member can filtrate paper powder or fine granules, or the like, it is used in the present invention as what filtrates ozone, and when extracting the filter member to replace it, the sheet output tray is not contaminated.

In the image formation apparatus, a fan is provided inside the apparatus body, and the fan can be extracted together with the filter member. Thus, together with replacing the filter member, the fan can be replaced or subjected to maintenance, which makes the image formation apparatus's maintenance convenient and increases its lifetime for use.

The above described image formation apparatus can provide an image formation apparatus allowing a filter to be easily replaced.

INDUSTRIAL APPLICABILITY

This image formation apparatus allows an ozone filter to be easily replaced and is applicable to a copying machine, a printer, a facsimile, and a multifunctional machine having these functions.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image formation apparatus comprising a sheet output tray and an apparatus body underlying the sheet output tray, the image formation apparatus having a duct inside the apparatus body, a filter member being provided inside the duct, the filter member having a portion exposed outside the apparatus body, the filter member's exposed portion also serving as a portion of the sheet output tray, wherein the filter member is disposed to have its heightwise direction inclined toward a downstream side in a sheet discharging direction.

2. The image formation apparatus according to claim 1, wherein the filter member is provided in a region of the sheet output tray forming a horizontal surface.

3. The image formation apparatus according to claim 1, wherein the filter member is an ozone filter.

4. An image formation apparatus comprising a sheet output tray and an apparatus body underlying the sheet output tray, the image formation apparatus having a duct inside the apparatus body, a filter member being provided inside the duct, the filter member having a portion exposed outside the apparatus body, the filter member's exposed portion also serving as a portion of the sheet output tray, wherein the filter member's exposed portion is flush with the sheet output tray, the filter member further has a handle, and the handle is provided at the exposed portion on a downstream side in a sheet discharging direction, the handle being configured such that pulling on the handle lifts the entire filter member out of the duct along a direction having a vertical component.

5. The image formation apparatus according to claim 4, comprising a reading unit overlying the sheet output tray.

6. The image formation apparatus according to claim 4, wherein the filter member's exposed portion is located in a region of the sheet output tray excluding a prescribed sheet output region.

7. The image formation apparatus according to claim 4, wherein the filter member is provided in a region of the sheet output tray forming an inclined surface.

8. The image formation apparatus according to claim 4, wherein the filter member is provided in a region of the sheet output tray forming a horizontal surface.

9. The image formation apparatus according to claim 4, wherein the filter member is disposed to have its heightwise direction perpendicular to a surface of the sheet output tray.

10. The image formation apparatus according to claim 4, wherein the filter member is disposed to have its heightwise direction inclined toward a downstream side in the sheet discharging direction.

11. The image formation apparatus according to claim 5, wherein the filter member has a height smaller than a minimum height from the sheet output tray to the reading unit.

12. The image formation apparatus according to claim 4, wherein the handle is provided on a side of the filter member closer to a user.

13. The image formation apparatus according to claim 4, having a push open member allowing the filter member to spring upward out of the apparatus body when the filter member is pushed.

14. The image formation apparatus according to claim 4, wherein the filter member is an ozone filter.

15. The image formation apparatus according to claim 4, wherein a fan is provided inside the apparatus body and the fan is extracted together with the filter member.

16. An image formation apparatus comprising a sheet output tray and an apparatus body underlying the sheet output tray, the image formation apparatus having a duct inside the apparatus body, a filter member being provided inside the duct, the filter member having a portion exposed outside the apparatus body, the filter member's exposed portion also serving as a portion of the sheet output tray, and the image formation apparatus having a push open member allowing the filter member to spring upward out of the apparatus body when the filter member is pushed.

17. The image formation apparatus according to claim 16, wherein the filter member is disposed to have its heightwise direction perpendicular to a surface of the sheet output tray.

18. The image formation apparatus according to claim 16, wherein the filter member is disposed to have its heightwise direction inclined toward a downstream side in a sheet discharging direction.

19. The image formation apparatus according to claim 16, wherein the filter member is an ozone filter.

* * * * *